US005552863A

United States Patent [19]

Genovese

[11] Patent Number: 5,552,863

[45] Date of Patent: Sep. 3, 1996

[54] XEROGRAPHIC PRINTER WHEREIN EXPOSURE AND DEVELOPMENT ARE PERFORMED ON OPPOSITE SIDES OF THE PHOTORECEPTOR

[75] Inventor: Frank C. Genovese, Fairport, N.Y.

[73] Assignee: Xerox Corporation, Stamford, Conn.

[21] Appl. No.: 391,818

[22] Filed: Feb. 21, 1995

[51] Int. Cl.[6] ..... G03G 13/00

[52] U.S. Cl. ..... 355/210; 347/137; 355/212; 355/237; 355/238

[58] Field of Search ..... 355/1, 210, 211, 355/212, 238, 326 R, 327, 237, 240; 347/154, 134, 137, 244, 258

[56] References Cited

U.S. PATENT DOCUMENTS

| | | | |
|---|---|---|---|
| 4,141,641 | 2/1979 | Nagal et al. | 355/1 |
| 4,141,642 | 2/1979 | Nagal et al. | 355/1 |
| 4,205,322 | 5/1980 | Tsuzuki et al. | 347/154 |
| 4,403,848 | 9/1983 | Snelling | 355/327 |
| 4,545,669 | 10/1985 | Hays et al. | 355/212 X |
| 4,717,999 | 1/1988 | Kaneko | 347/154 X |
| 4,757,332 | 7/1988 | Yuasa | 347/154 X |
| 4,766,447 | 8/1988 | Tsukada | 347/154 X |
| 4,921,316 | 5/1990 | Fantone et al. | 350/96.27 |
| 4,974,928 | 12/1990 | Caufield | 350/96.27 |
| 5,074,683 | 12/1991 | Tarn et al. | 385/120 |
| 5,257,045 | 10/1993 | Bergen et al. | 346/159 |
| 5,272,508 | 12/1993 | Sakakibara et al. | 355/211 X |
| 5,291,246 | 3/1994 | Tsukamoto | 355/210 |
| 5,300,962 | 4/1994 | Genovese | 346/108 |
| 5,332,642 | 7/1994 | Simms et al. | 430/125 |

*Primary Examiner*—Robert Beatty
*Attorney, Agent, or Firm*—R. Hutter

[57] ABSTRACT

A xerographic print engine includes a rotatable photoreceptor belt. The photoreceptor is exposed by delivering energy to the inward-facing side of the belt, and the electrostatic latent image is developed by applying toner to the outward-facing side of the belt. The system is particularly useful for liquid-development based xerographic systems, as multiple layers of toner can be accumulated on the outward-facing side of the photoreceptor belt without interfering with subsequent exposure steps. A cylindrical lens is in contact with the photoreceptor belt and is adapted to focus light from a light source at a developing region of the photoreceptor belt.

20 Claims, 5 Drawing Sheets

Figure 1:
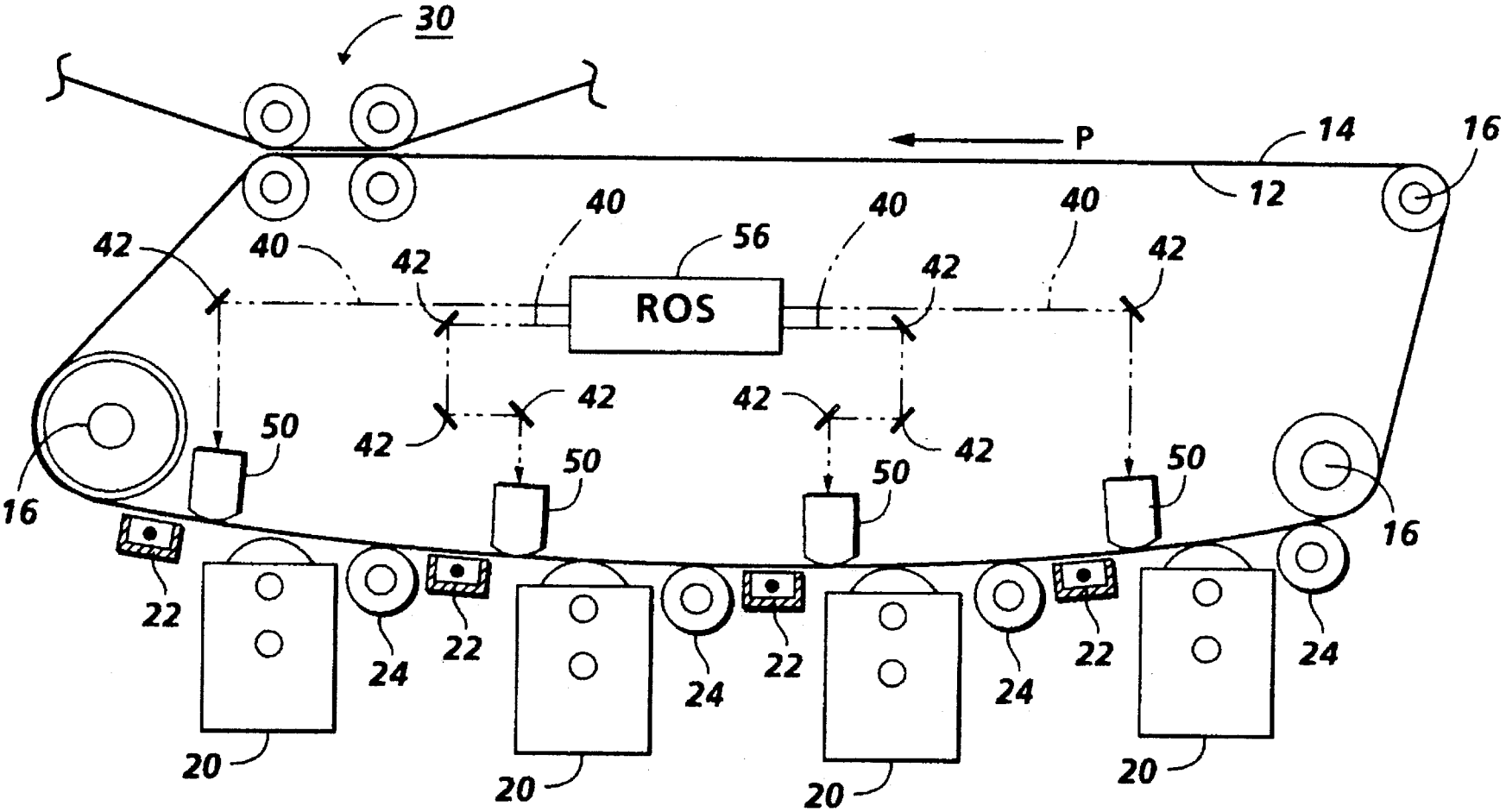

XEROGRAPHIC PRINTER WHEREIN EXPOSURE AND DEVELOPMENT ARE PERFORMED ON OPPOSITE SIDES OF THE PHOTORECEPTOR

The following patents, the first three assigned to the assignee hereof, are incorporated herein by reference: U.S. Pat. No. 4,403,848; U.S. Pat. No. 5,257,045; U.S. Pat. No. 5,300,962; U.S. Pat. No. 5,332,642; U.S. Pat. No. 4,921,316; U.S. Pat. No. 4,974,928; U.S. Pat. No. 4,141,641; U.S. Pat. No. 4,141,642; and U.S. Pat. No. 5,074,683.

The present invention relates to a system for creating electrostatic latent images on a photoreceptor in a xerographic printing apparatus, with particular utility in printing apparatus wherein marking particles are suspended in a liquid medium.

Xerographic copiers and printers, in which an electrostatic latent image is created on a charge-retentive surface and the image is developed by applying toner particles to the latent image, are well-known. As xerographic printers capable of full-color image production are coming into general use, it is common to find single pass designs in which toners of various primary colors are sequentially accumulated on the photoreceptor to create full-color images. In a typical full-color single pass design, there may be provided four separate development stations (for the three primary color separations and black) positioned along the path of a photoreceptor moving in a process direction. As the photoreceptor advances to each development unit, the photoreceptor surface is charged and exposed in areas thereof corresponding to the requirements of the particular primary color separation for the full-color image being printed. For example, just ahead of the magenta development unit in the process direction, the photoreceptor is charged and the areas in which magenta is required in the full-color image are exposed by, for example, the laser beam of a raster output scanner (ROS) or a light emitting diode (LED) array printbar. Similarly, just before the cyan, yellow, or black development units, the photoreceptor is recharged and exposed in patterns corresponding to those color components in the desired full color image being printed.

A design challenge which is peculiar to this type of full-color imaging is the fact that, after the first color in the sequence is exposed and developed on the photoreceptor, subsequent exposure through one or more layers of previously-developed toner are required. Thus, if in a particular design the first development unit develops the magenta image component, and the second the cyan component, the cyan exposure necessarily takes place through a previously deposited pattern of magenta toner on the photoreceptor surface. This type of full-color imaging in which successive layers of toner are accumulated on the photoreceptor is generally known as "image-on-image" color xerography. At the fourth development unit, the photoreceptor must be exposed through as many as three separate layers of toner. Although image-on-image xerography has certain advantages, there are practical difficulties as well. For example, if the exposure patterns for each successive color are created by a laser scanner, it will be necessary to utilize a wavelength which can penetrate previous layers of toner; in other words, the laser should emit light at a wavelength where the layers of toner have little or no absorption. Further, even though a wavelength is chosen where toner absorption is low, the multiple toner layers cause appreciable scattering of the incident light beam, causing irregular diffusion of the exposure pattern.

Small toner particles are necessary in high resolution color imaging. Recently, there has been commercial activity utilizing very fine toner "liquid-ink development" (LID) techniques. In LID systems, the toner particles which are applied to develop the electrostatic latent images on the photoreceptor are suspended in a liquid medium. One advantage of a liquid suspension is that very small toner particles in bulk form are difficult to transport and confine in a "dry" powder system. Poor confinement implies unacceptable clouds of stray toner particles emitted from the printing apparatus. By retaining the toner particles in a liquid medium, the toner particles are less likely to become airborne and contaminate the printing machine environment. Typical preferred liquid media for liquid ink development include the solvents known under the trade names "Norpar" and "Isopar," which are particularly useful for their dielectric properties, low viscosity, low toxicity, and low vapor pressure.

One of several practical concerns with LID systems is that, following each development step, a quantity of liquid medium is retained on the photoreceptor surface, and this excess liquid medium must be drawn off, or "blotted," from the photoreceptor before the next development step can proceed. It is common to include a device known as a "blotter," "image stabilizer" or "image conditioning device" in a LID system, which is typically in the form of a short belt or roller in contact with the photoreceptor, the roller surface having a porosity which removes excess liquid medium through a combination of mechanical expunging and vacuum assisted capillary action. Thus, in a full-color LID printing system, the path of the photoreceptor belt is fairly crowded with essential processing mechanisms, requiring, in addition to the imaging device providing the photoreceptor exposure, at least one charging unit as well as four development units and four blotters, each blotter following a development unit. Because of the limited space available along the photoreceptor length, the design and configuration of the required hardware modules becomes a significant architectural challenge; in particular it may be impossible to arrange the components so that the four photoreceptor exposure points can be serviced by a central polygon scanner with four separate beams. The alternative of employing separate polygon scanners or LED array printbars for each color provides more architectural freedom, but at the expense of additional bulky hardware and electronic support subsystems.

According to one aspect of the present invention, there is provided an electrostatographic printing apparatus, comprising a charge receptor, in the form of a substrate defining an exposure surface and a development surface opposite the exposure surface. An exposer delivers energy to the exposure surface, creating imagewise charged and discharged areas apparent on the development surface. A development unit, operatively disposed adjacent the development surface, develops the electrostatic latent image by placing toner particles on the development surface.

According to another aspect of the present invention, there is provided an electrophotographic printing apparatus, comprising a photoreceptor, in the form of a substrate defining a development surface for the retention of an electrostatic latent image thereon. A shoe defines a sliding surface in slidable contact with a surface of the photoreceptor, and is adapted to focus light from a light source substantially at the development surface of the photoreceptor.

According to another aspect of the present invention, there is provided an electrostatographic printing apparatus, comprising a photoreceptor, in the form of a belt encompassing a volume within the apparatus, defining an exposure surface on an inward-facing surface of the belt and a development surface on an outward-facing surface of the belt. An exposer, including a light source directing a light beam toward the exposure surface of the photoreceptor, creates imagewise charged and discharged areas apparent on the development surface. A development unit, operatively disposed adjacent the development surface, develops the electrostatic latent image by applying to the development surface toner particles suspended in a liquid medium. A shoe, defining a sliding surface in slidable contact with a portion of the exposure surface, and being transmissive of light emitted by the light source, focuses light from the light source substantially at the development surface of the photoreceptor. A light-transmissive fluid lubricant is disposed between the sliding surface of the shoe and the exposure surface of the photoreceptor. The lubricant is miscible with the liquid medium.

According to another aspect of the present invention, there is provided an electrostatographic printing apparatus, comprising a photoreceptor, in the form of a belt encompassing a volume within the apparatus, defining an exposure surface on an inward-facing surface of the belt and a development surface on an outward-facing surface of the belt, the belt being movable in a process direction. An exposer includes at least one light source directing a first light beam toward a first exposure location and a second light beam toward a second exposure location of the exposure surface of the photoreceptor along the process direction. A first development unit and a second development unit, respectively disposed adjacent the development surface at locations along the process direction downstream of the first exposure location and the second exposure location, each develop an electrostatic latent image by applying to the development surface toner particles suspended in a liquid medium. A shoe is disposed at each exposure location, each shoe defining a sliding surface in slidable contact with a portion of the exposure surface. Each shoe is transmissive of light emitted by the light source, and focuses light from the light source substantially at the development surface of the photoreceptor. A light-transmissive fluid lubricant is disposed between the sliding surface of each shoe and the exposure surface of the photoreceptor. The lubricant is miscible with the liquid medium.

Figure 2:
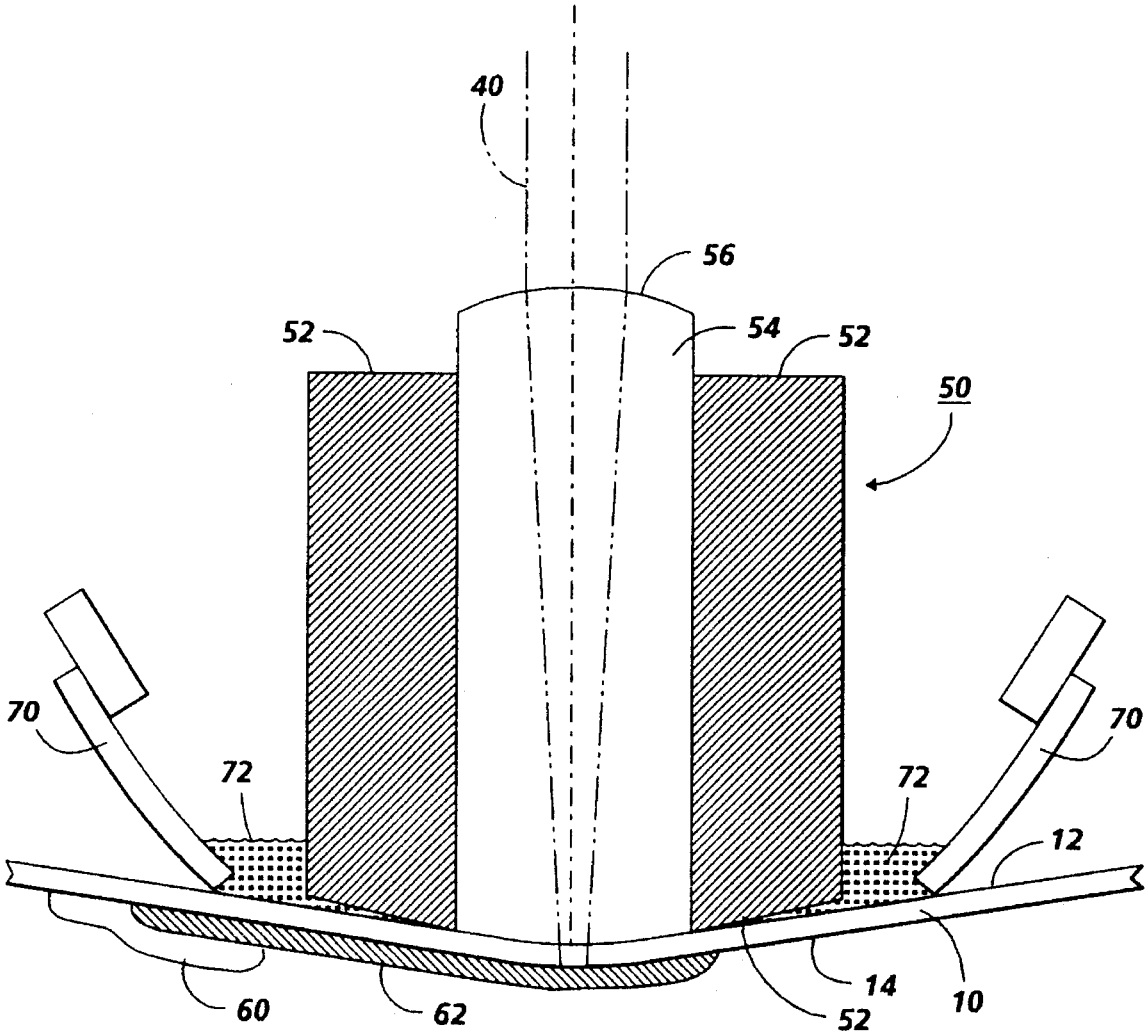
Figure 3:
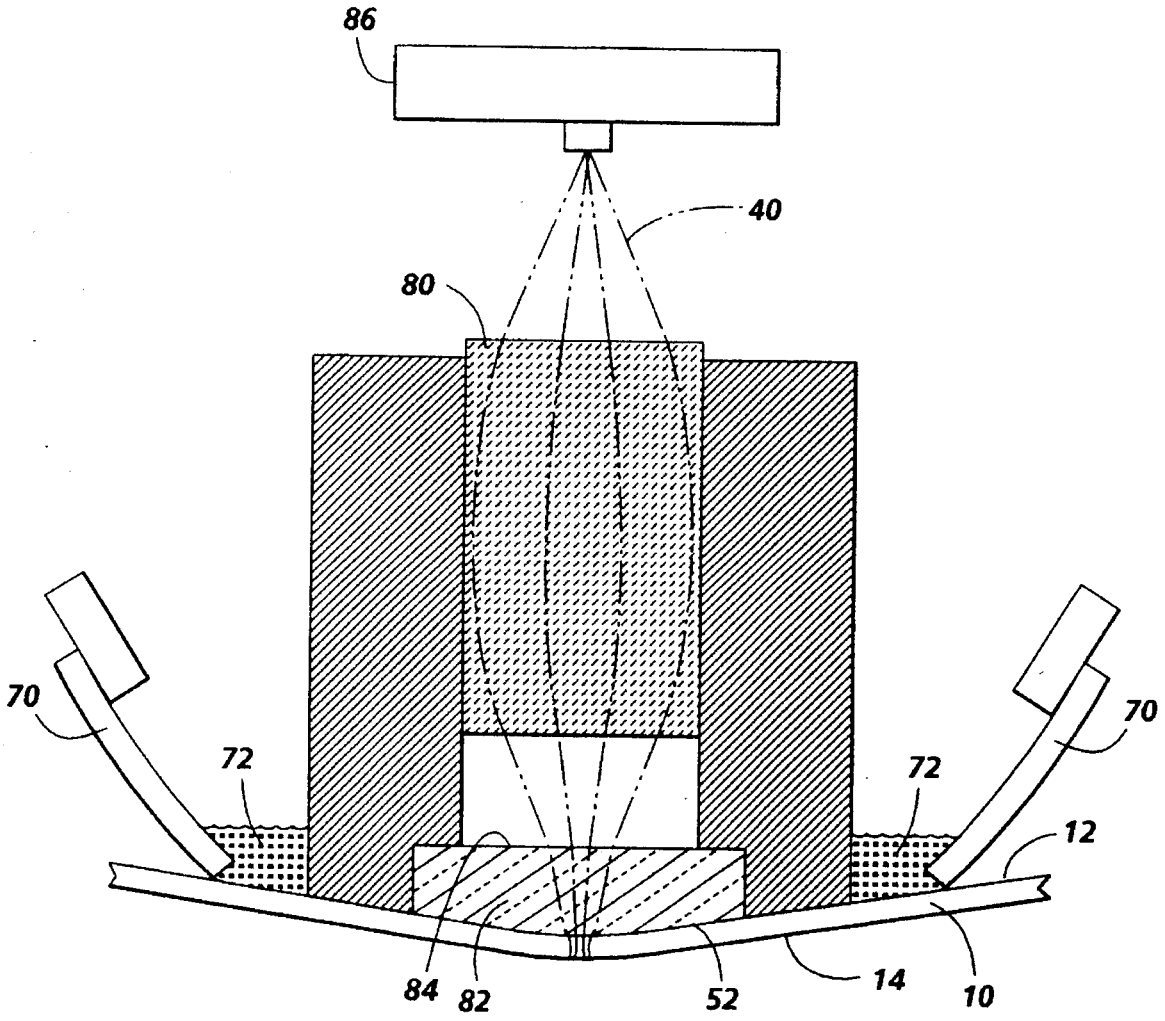
Figure 4:
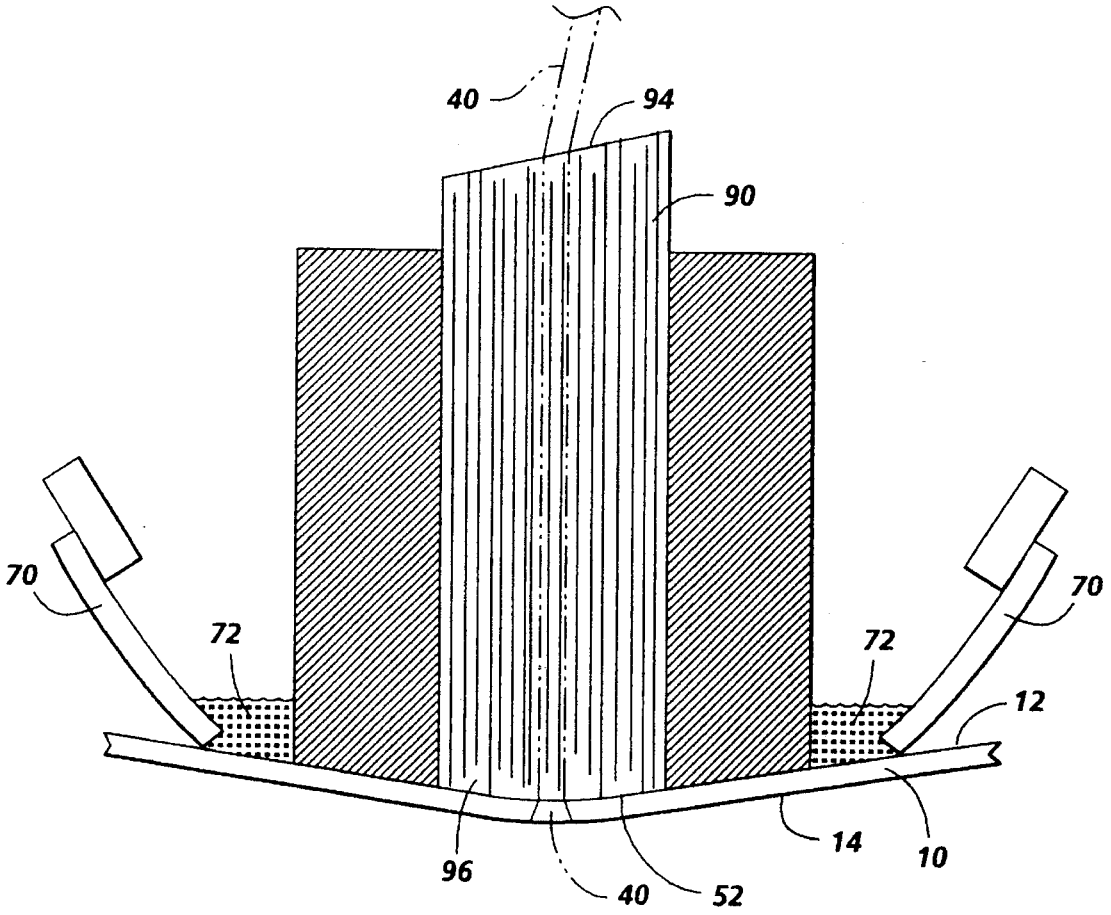
Figure 5:
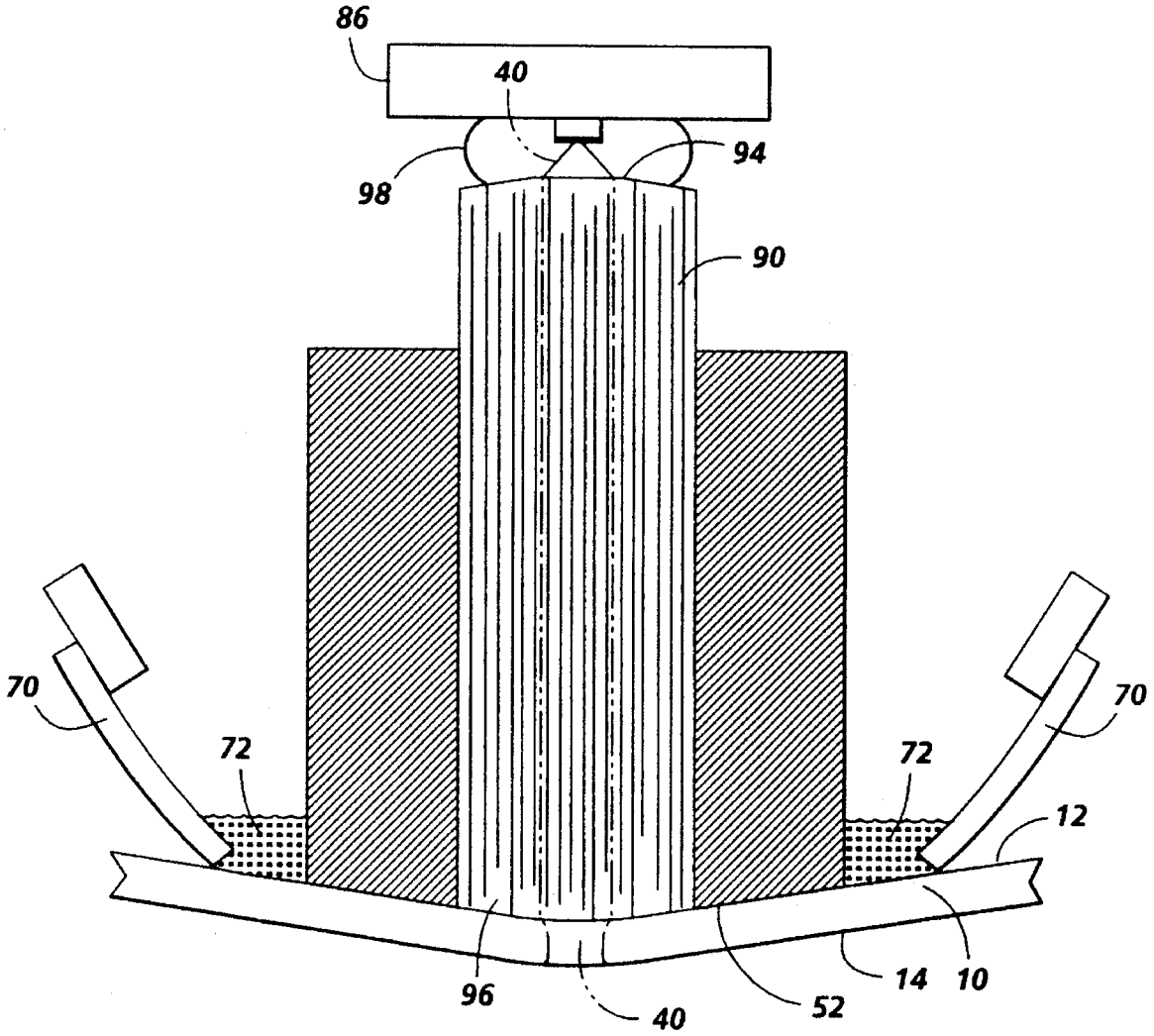

In the drawings:

FIG. 1 is an elevational view showing the basic elements of a full-color, image-on-image, liquid-ink development print engine incorporating the present invention;

FIG. 2 is a sectional elevational view showing in detail a shoe according to the present invention placed at an exposure area in the print engine of FIG. 1; and FIG. 3 is a sectional elevational view, equivalent to that shown in FIG. 2, of a shoe in the form of a LED array printbar; and FIGS. 4 and 5 are sectional elevational views, equivalent to that shown in FIG. 2, showing different embodiments of a shoe including a coherent fiber optic element.

FIG. 1 is a simplified elevational view showing the essential elements of a liquid-ink development (LID) based full-color xerographic print engine, incorporating the present invention. The apparatus comprises a charge receptor, here in the form of a rotating belt photoreceptor 10, which moves in process direction P. According to the present invention, this photoreceptor belt 10 includes an inward-facing exposure surface 12 and an outward-facing development surface 14 opposite thereof. The photoreceptor belt 10 is entrained on rollers 16, and also on stabilizing shoes as shown in the Figure.

In a full-color, image-on-image xerographic print engine, there are provided four development units, each unit capable of developing toner of a primary color or black in imagewise fashion on the electrostatic latent images created on photoreceptor 10. In the illustrated print engine, the four development units, each indicated as 20 and further marked with a color letter for yellow (Y), magenta (M), cyan (C), and black (K), are sequentially disposed along process direction P and capable of delivering toner particles to the outward-facing development surface 14 of photoreceptor belt 10.

As can be further seen in the view of FIG. 1, each development unit 20 is preceded along the process direction P by a charging device 22 and followed by a blotter 24. The function of the charging device, which may be of any design known in the art, is to provide charge on the photoreceptor surface in preparation for the exposure step, in a manner familiar in the art of xerography. Additional charging devices (not shown) may be strategically located for charge neutralization and image stabilization purposes. The function of blotter 24, which is particular to LID-based printing engines, is to draw off excess liquid medium from the development surface 14, immediately following the liquid-ink development step. Briefly, in a LID-based system, the toner particles that adhere to the development surface 14 in imagewise fashion according to a desired image to be printed are initially suspended in a liquid medium which bathes the development surface 14 at the development unit 20. When the liquid-ink suspension contacts the development surface 14, the entrained toner particles migrate through the liquid medium and adhere to those areas of the photoreceptor surface which are charged. Only those areas which remain charged following the exposure step support an electric field that attracts the toner particles, drawing them through the liquid medium. Nonetheless, in spite of the strong toner adhesion forces, a substantial quantity of liquid medium tends to remain in the toner deposits after the development step. It is the function of image conditioners such as blotter 24 to remove this excess,liquid medium, so that toner deposits remaining in imagewise fashion on the development surface 14 of photoreceptor 10 exhibit as high cohesion as possible before being subjected to subsequent imaging steps. Conditioning the image also reduces the background level and improves edge definition by removing residual toner entrained in the excess medium, and minimizes carry-through or cross contamination of toner particles between the developer units. It has been found that the process of transfuse, wherein the four superimposed toner images on the photoreceptor development surface 14 are transferred to the final output sheet using a combination of heat, pressure, and applied electric field, results in essentially 100% transfer when the toner has been sufficiently conditioned. One typical design of a blotter such as 24 would include a roll having a highly porous outside surface, which is adapted to draw off the excess liquid medium from the development surface 14. For an example of a basic LID system using a blotter, reference is made to U.S. Pat. No. 5,332,642, incorporated herein by reference.

In a full-color apparatus, sequentially generated latent images on the photoreceptor belt 10 are processed by four development units 20 so that toner of all three primary subtractive colors and black are deposited as necessary on the photoreceptor belt to form the full-color image. After the full-color image has been deposited and conditioned, photoreceptor 10 is advanced to a transfer station, here generally indicated as 30, in which the composite toner image is transferred to a print sheet. Various mechanisms of transfer using pressure, heat and electric field are generally familiar to one of skill in the art, although it is to be expected that a transfer system of particular utility in a LID-based apparatus would be optimized for that application. Also, there may be included along the process direction of photoreceptor 10 any number of other mechanisms for improving and maintaining print quality, such as a post-transfer cleaning device, or a pre-transfer charging device.

For each primary color in the process, there is disposed between charging device 22 and development unit 20 an exposure location, so that the necessary color separation image for the particular primary color may be created by imagewise discharging of the charged photoreceptor. As used in the claims herein, any device for delivering energy (such as light energy) to a charge receptor, to create imagewise discharged and charged areas thereon is defined as an "exposer." As is well known in the art of "laser printing," the most common technique for creating imagewise discharged and charged areas on a photoreceptor prior to development is to scan a focussed laser beam across the photoreceptor surface in a path perpendicular to the process direction P. The laser beam is modulated according to digital image data so as to discharge certain areas of the photoreceptor and create an electrostatic latent image corresponding to the pattern of toner desired in the finished image. The scanning action of the laser beam is typically accomplished by means of a rotating polygon mirror, having reflective facets on its edges, which is designed to deflect the modulated laser beam at high rate to form a closely spaced raster of scan lines on the surface of advancing photoreceptor 10.

In typical prior-art exposure systems, this exposing laser beam raster is incident on the same face of photoreceptor 10 as subsequent development; that is, the laser beam is directed to selectably discharge photoreceptor 10 from the same side that will subsequently be bathed by the liquid toner suspension in the development unit, and to which the toner particles migrate to form the image. The limited space available along the photoreceptor is a significant factor in the architectural design of a full color system. Further, optimization of the individual xerographic processing units often dictates that they physically overlap in such a way that the laser beam cannot be projected directly to the desired exposure points. As a consequence, the optical path must be folded into multiple segments in order to avoid interference with the xerographic units as well as their supports, supply tubes, and control cables. The mirror surfaces providing the more complex path require additional mountings and adjustments which add to the overall complexity and cost, and reduce robustness.

According to the present invention, it is intended that the exposure apparatus, which may typically include multiple scanning laser beams, operate by delivering exposure energy to the photoreceptor belt face opposite the development units, in this case what has been labeled exposure surface 12 of photoreceptor 10, which is the inward-facing side of the rotatable belt shown in the figures. As can be seen in FIG. 1, the raster output scanner or ROS, which may be generally of a design familiar in the art, including one or more rotating polygon mirrors, emits separate beams, each beam corresponding to a different primary color in the finished image, toward the portions of the exposure surface 12 at locations along the process direction between each charging device 22 and development unit 20. In FIG. 1, a ROS generally indicated as 36 is shown emitting four light beams, each indicated as 40, each directed by means of mirrors 42 to the appropriate locations along the photoreceptor belt 10. For an example of ROS systems emitting four independent beams suitable for full-color imaging, reference is made to U.S. Pat. No. 4,403,848 and U.S. Pat. No. 5,300,962, both assigned to the assignee hereof and incorporated herein by reference.

At the location along the process direction P where the beam 40 exposes the exposure surface 12 of photoreceptor belt 10, there is, according to one aspect of the present invention, disposed a belt guiding "shoe" 50, which slidably contacts the exposure surface 12 of photoreceptor belt 10. FIG. 2 is a detailed elevational view of such a shoe, generally indicated as 50. As can be seen, the shoe 50 defines a generally convex cylindrical sliding surface which is contacted by the exposure surface 12 of photoreceptor belt 10. The main element of a shoe 50 are its optical cylinder lens element 54 and the convex sliding surface which may be extended by flanking support members 52 as shown in FIG. 2. Cylinder lens element 54 is an integral part of the scanning optical train designed to minimize the scanning anomaly known as polygon wobble which is common in the art of raster output scanners. For a detailed description of the operation of such a cylinder lens, reference is made to, for example, U.S. Pat. No. 5,300,962. Preferably, cylinder lens element 54 defines the path of the scan line generated by a laser beam such as 40 which is incident on the development side 14 of photoreceptor belt 10. An entry surface 56, forming the refracting surface at the top of cylinder lens 54 in FIG. 2, is configured to create an optical beam waist that projects through the inward facing exposure surface 12 of photoreceptor belt 10 and is centered on the photosensitive volume adjacent to the surface of development side 14.

Although, according to the present invention, the energy for providing the necessary imagewise discharging is provided on the exposure surface 12 of photoreceptor belt 10, it is intended that the effect of such discharge, meaning the fact that certain areas of the belt 10 are charged differently than others, be apparent, in an electrostatic sense, on the development surface 14 of photoreceptor belt 10. That is, although the energy for the discharging is delivered to the "back" exposure surface 12 of the photoreceptor belt 10, the effect of this energy will create the necessary charged and discharged areas as if it had instead been incident on the "front" side of the photoreceptor, meaning the development surface 14. Such a result is possible with several types of photoreceptors which are currently commercially available. Many commercially available "active-matrix" (AMAT) photoreceptors include a substrate made of a material such as that known under the trade name "Mylar." Such a material, and many others similarly available, is essentially transparent. Even when such a photoreceptor structure includes an electrically conducting ground plane made of a thin semi-transparent evaporated metal coating such as aluminum, as is known in the art, the basic transmission of light through the photoreceptor structure may be reduced but is not necessarily eliminated. It is also known that coatings of indium and tin oxide compounds can be substituted for the metallic layer to provide the electrical ground plane function with very little transmission loss. In this case, all the absorption takes place in the transport and photogeneration layers of the photoreceptor structure. The partial transmission through the body of the photoreceptor structure enables exposure and development to be carried out on opposite sides of the belt photoreceptor 10.

It is common in the art of "laser printing" to utilize lasers operating as low as 3 milliwatts of power output and delivering as little as 0.5 milliwatts to the photoreceptor surface through the scanner system. Even if only 10% of the light flux remains after transmission through a photoreceptor, then a 30 milliwatt laser delivering a 5 milliwatt beam incident on the reverse side of the photoreceptor would be equivalent in exposing power; this operating level is well within the range of commercially available laser sources.

Because the exposing flux of laser beam 40 is applied from the reverse side through the transmissive photoreceptor 10, latent image generation takes place without direct interaction with toner previously deposited on the development surface 14. Colored toner layers 60 and 62 from previous processing steps are shown on the development surface 14 of photoreceptor belt 10 in the detail of FIG. 2. Because the laser beam 40 does not pass through these toner layers 60 and 62, any number of layers can be accumulated on the development surface 14 without affecting the exposure characteristics of photoreceptor 10 in subsequent discharging steps. In contrast, in a conventional system wherein the exposure is incident on the development side of photoreceptor 10, the laser beam must penetrate the deposited toner layers such as 60, 62 in order to interact with photoreceptor 10. As mentioned above, such a situation in image-on-image xerography can introduce unwanted imaging artifacts due to light scattering and absorption in the toner layers that are difficult to correct, or require the use of a long wavelength exposure system design that minimizes the toner interactions. With the system of the present invention, however, the laser beam 40 can be in the visible wavelength range with the optical performance advantage of a shorter wavelength system.

Also shown in FIG. 2 are a pair of conformable blades 70 immediately upstream and downstream of the shoe 50. These blades 70 are typically made of an elastomeric plastic material, and are positioned to confine a quantity of fluid lubricant, hereshown as 72, to the general area around shoe 50 in such a way that a film of the fluid lubricant 72 is constantly maintained between the sliding surface 52 of shoe 50 and the exposure surface 12 of photoreceptor belt 10. The blades 70 thus act as a "liquid dam" for retaining an adequate supply of fluid lubricant 72 on the upstream side of shoe 50, and a cleaner blade or wiper on the downstream side of shoe 50 to contain the fluid lubricant 72 for recycling and removal from the belt.

In an imaging architecture with sequential color processing units in which multiple shoes 50 are used in succession, it may be sufficient to include a single pair of blades 70, the first blade positioned on the upstream side of the first shoe to contain the fluid lubricant supply, and the second blade located on the downstream side of the last shoe for removing the fluid lubricant 72 from the belt. In this case it may also be convenient to include intermediate wicks or similar passive devices (not shown) that contact the exposure surface 12 of photoreceptor belt 10 to redistribute and even out the fluid lubricant supply between multiple shoes 50. Fluid lubricant 72 acts to reduce sliding friction in the contact between the photoreceptor 10 and the sliding surface 52, minimizing mechanical abrasion of both surface 52 and the exposure surface 12 of photoreceptor belt 10. It will be appreciated that lubricating fluid also reduces friction when applied between photoreceptor belt 10 and drive rolls such as 16. However, it has been found that by employing a conformable elastomer blade in firm contact in a cleaning configuration, the inner surface of photoreceptor belt 10 can be rendered essentially free of lubricating fluid before being engaged by the drive rolls 16.

In addition to reducing friction and abrasion, the film of fluid lubricant 72 in the interface between the sliding surface 52 of shoe 50 and the exposure surface 12 of photoreceptor belt 10 provides an important optical matching function. Over the life of the apparatus it is expected that any number of cracks, scratches, and other imperfections inevitably appear on sliding surface 52, and the inner surface of photoreceptor belt 10 as a result of long-term repetitive contact with, for example, roller 16, and as a result of unavoidable mechanical abrasion processes suffered along the belt path. By choosing a transparent fluid with an optical index of refraction intermediate between the refractive index of the contacted belt material and the refractive index of the transparent portion of sliding surface 52 of shoe 50, optical reflection losses due to any interface index mismatch are virtually eliminated. As a consequence, the film of fluid lubricant in the interface between these two optical surfaces substantially improves their effective optical clarity for efficient laser beam transmission by immersing the scratches, defects, and abrasions on both surfaces in a medium of nearly the same refractive index which renders the defects optically invisible. Even when the fluid index of refraction is not optimum, the optical clarity of worn interface surfaces can be seen to improve markedly when fluid is added.

In spite of its generally curved shape, sliding surface 52 and conforming exposure surface 12 preferably have no net refracting power for the rays passing through index matching fluid lubricant 72. The net refraction on writing beam 40 in passing through cylinder lens element 54 in FIG. 2 is due solely to the action of entrance surface 56 of cylinder lens element 54. In FIG. 2 the physical length of the transparent section between the optical surface of cylinder lens 56 and the photosensitive portion of belt 10 is rigidly defined so that the writing beam 40 projects a beam waist centered on the photosensitive portion of belt 10 for optimum focus.

Preferred materials to serve as the fluid lubricant 72 include the materials known under the trade names "Norpar" and "Isopar." As mentioned above, these materials are also useful as the liquid medium in a LID-based development unit. These materials are useful both for their viscosity and low vapor pressure characteristics. It has been found, in practice that operation of many LID-based systems, that small quantities of stray Norpar or Isopar inevitably spreads through the system, including getting on the "back" (that is, on the exposure surface 12) of photoreceptor belt 10. Thus, in practical LID-based systems, the entire print engine may be effectively "immersed" in a fluid such as Norpar or Isopar. Fortunately, this liquid medium, which is parasitically loose in the system anyway in a LID-based engine, can serve as the fluid lubricant for perfecting the exposure of laser beam 40 through cylinder lens 54. Even if different types of fluid are used as the fluid lubricant and for the liquid medium, it is desirable that the two liquids be miscible, so that any accidental mixing of the fluid lubricant and the liquid medium will not have a detrimental effect on the operation of the print engine as a whole. Most preferably, the liquid medium for the development units and the fluid lubricant for the shoes are the same substance, so that mixing thereof is immaterial.

Another possible variant to a "shoe" is to incorporate therein an LED (light emitting diode) array printbar, an exposure device extending across the photoreceptor and adapted to selectably discharge imagewise selected small areas on the photoreceptor as the photoreceptor moves past the shoe, in a manner generally familiar in the art. The individual LEDs in such a shoe could be optically coupled to generate the exposure pattern in one of several ways including a proximity arrangement in which the emitting LED elements are placed very close to the sliding surface 52 of such a shoe 50, and may indeed form part of the sliding surface. Alternately, or the use of gradient index (GRIN) lens arrays in which the emitting LED elements and photosensitive surface are optical conjugates and sliding surface 52 forms the outer face of a generally convex optical output window, or the use of a coherent fiber optic bundle shaped on its output end to form a generally convex sliding surface 52.

FIG. 3 shows a configuration where a gradient index lens array 80 such as those known under the trade name "Selfoc" and manufactured by Nippon Sheet Glass of Japan is used to image the light output of a linear LED array print bar 86 on the photosensitive portion of belt 10. In the Figure there is shown one representative LED which forms part of a linear array 86 extending into the page. An "output window" 82 has an optically plane inner surface 84 and a generally convex outer sliding surface 52 contacting exposure surface 12 through an optically coupling film of fluid lubricant 72 as described previously. Thus output window 82 with optically plane inner surface 84 in FIG. 3 behaves as a plane window for the exposing light flux projected by the GRIN lens array 80, so that a light beam such as indicated by 40 (which here is emitted by LED 86, as opposed to the ROS of FIG. 1) is focused on development surface 40 through the photoreceptor belt 10. The GRIN lens array 80 and LED array sources 86 are positioned with respect to the output window 82 so that the photosensitive portion of belt 10 is maintained at the output conjugate of the GRIN lens array for optimum focus.

FIG. 4 illustrates the use of a coherent fiber optic bundle 90 to relay exposing light flux 40 front a remote source (not shown) to the sliding surface 52. In this case the fibers of bundle 90 are oriented in a vertical direction as illustrated in FIG. 4, and output end 96 is shaped to form a generally convex outer sliding surface 52. Input end 94 may have any preferred surface shape consistent with the nature of the light source. Furthermore, the fiber paths may be essentially straight as shown in FIG. 4, or can be deformed to conduct the light flux in any arbitrary path over short or long distances while maintaining imaging coherency with little loss in efficiency, as is well known in the fiber optic art. In a preferred embodiment of the configuration illustrated in FIG. 4, coherent bundle 90 is fabricated of clad glass fibers fused into a solid member that can be ground and polished using standard optical methods.

The nature of the fibers is such that light flux emitted from a fiber end spreads out in a characteristic cone defined by the characteristic N.A. (numerical aperture) of the fiber. As a result of the angle of spread, the photosensitive portion of belt 10 must be in close proximity to the fiber end to prevent significant blurring or diffusion of the desired exposure pattern as indicated in FIG. 4. For a coherent bundle with fibers of N.A. 0.3, the cone angle in air is approximately 18 degrees. When the same fiber end is immersed in fluid lubricant 72 as in the sliding contact described previously, the cone angle is reduced to approximately 12 degrees and the effective depth of focus is 3 or 4 mils, roughly the thickness of a typical photoreceptor belt. For examples of LED print bar arrays integrated directly on coherent fiber optic substrates, reference is made to U.S. Pat. No. 4,921,316 and U.S. Pat. No. 4,974,928 incorporated herein by reference.

In the case of the gradient index coupling method illustrated in FIG. 3 and the coherent fiber optic coupling method shown in FIG. 4, the absolute position and skew of the exposure delivered to photoreceptor belt 10 can easily be adjusted for image registration purposes by direct translation one or both ends of the shoe structure upstream or downstream with respect to the advancement direction of belt 10. Registration and skew adjustment is likewise easily adjustable in the polygon ROS exposure system described in FIGS. 1 and 2 by displacing the cylinder lens shoe structure 50 upstream or downstream with respect to the advancement direction of belt 10 in exactly the same mannor. For a detailed description of the operation of such a cylinder lens and the principle of imaging skew and registration adjustment by cylinder lens translation, reference is again made to, U.S. Pat. No. 5,300,962.

As a consequence of ordered constructive interference, a point source placed in close proximity but not in direct contact with the input face of an optically polished high quality coherent fiber optic bundle produces a light flux concentration or "focus" displaced an equal distance away from the output face as illustrated in FIG. 5. For an example of a coherent fiber optic imaging system using this extended focus mechanism, reference is made to U.S. Pat. No. 4,141,641 and U.S. Pat. No. 4,141,642, incorporated herein by reference. Using this technique, the effective depth of focus for imaging with a coherent fiber arrangement similar to that illustrated in FIG. 4 can be extended by positioning an array of sources, like LED printbar emitters or an electron excited phosphorescent member such as a CRT screen or vacuum fluorescent anode (not shown), a small distance, for example 8 mils (0.008 inches), from the input end 94 of the fiber optic bundle 90. The "best focus" for exposure of beam 40 would therefore be found spaced approximately 8 mils distant from the output end 96 and would be useful in conjunction with a photoreceptor structure such as belt 10 with an internal photosensitive volume centered 8 mils from exposure surface 12, and therefore right adjacent development surface 14, as indicated in FIG. 5. Since the "focus" in this imaging arrangement is formed within a volume consisting of fluid lubricant 72 and the photoreceptor belt, both with refractive indices of approximately 1.5, for optimum results the source should also be immersed in a similar refractive index medium which can be accomplished with optical spacers, by putting the sources in a compound such as a bead 98 of optical epoxy, or even immersion of both the source and input end 94 in a liquid with an index of refraction of 1.5. For an example of a matched index material used to couple a device to a fiber-optic substrate, reference is made to U.S. Pat. No. 5,074,683, incorporated herein by reference.

In the case of the gradient index coupling method illustrated in FIG. 3 and the coherent fiber optic coupling method shown in FIG. 4, the absolute position and skew of the exposure delivered to photoreceptor belt 10 can easily be adjusted for image registration purposes by direct translation one or both ends of the shoe structure upstream or downstream with respect to the advancement direction of belt 10. Registration and skew adjustment is likewise easily adjustable in the Polygon ROS exposure system described in FIGS. 1 and 2 by displacing the cylinder lens shoe structure 50 upstream or downstream with respect to the advancement direction of belt 10 in exactly the same manner. For a detailed description of the operation of such a cylinder lens and the principle of imaging skew and registration adjustment by cylinder lens translation, reference is again made to U.S. Pat. No. 5,300,962.

A key advantage of the present invention is that it facilitates a print engine architecture, such as shown in FIG. 1, wherein the principal exposing devices of the system, such as ROS 36 and plane mirrors 42, are disposed within the volume encompassed by the photoreceptor belt 10. In conventional print engines designs the substantial volume encompassed by the photoreceptor belt 10 is unused or considered "dead space," because all of the xerographic processes are applied on the outward-facing surface of the belt. However, because the imaging apparatus for exposing the photoreceptor belt 10 in the present invention can be placed wholly inside the perimeter of belt 10, a more compact print engine design can be created. Such an advantage is of particular significance in developing large-scale: full-color printing engines. The present invention facilitates engine designs of much smaller "foot print" with no loss in performance, and with a wider range of engineering options compared to equivalent conventional designs wherein exposure and development are applied from the same side of the photoreceptor belt.

While the invention has been described with reference to the structure disclosed, it is not confined to the details set forth, but is intended to cover such modifications or changes as may come within the scope of the following claims.

I claim:

1. An electrostatographic printing apparatus, comprising:

a charge receptor, in the form of a substrate defining an exposure surface and a development surface opposite the exposure surface;

an exposer, adapted to deliver energy to the exposure surface, creating imagewise charged and discharged areas apparent on the development surface, the exposer including a light source for selectably discharging areas of the charge receptor;

a development unit, operatively disposed adjacent the development surface, for developing the electrostatic latent image by placing toner particles on the development surface; and a shoe, the shoe being transmissive of light emitted by the light source, and defining a sliding surface in slidable contact with a portion of the exposure surface and including a cylinder lens for light emitted by the light source.

2. The apparatus of claim 1, wherein the charge receptor is in the form of a rotatable belt encompassing a volume within the apparatus, and wherein the exposer includes optical elements disposed within the volume.

3. The apparatus of claim 1, wherein the cylinder lens focuses light emitted by the light source substantially at the development surface of the charge receptor.

4. The apparatus of claim 1, further comprising a fluid lubricant disposed between the sliding surface of the shoe and the exposure surface of the charge receptor.

5. The apparatus of claim 4, further comprising a retainer for retaining a quantity of lubricant around the shoe.

6. The apparatus of claim 4, wherein the lubricant is light-transmissive.

7. The apparatus of claim 4, wherein the development unit applies to the development surface toner particles suspended in a liquid medium, the liquid medium being miscible with the lubricant.

8. The apparatus of claim 7, wherein the lubricant and the liquid medium are chemically substantially identical.

9. The apparatus of claim 7, further comprising a blotter for drawing excess liquid medium from the development surface after the development unit applies toner and liquid medium to the development surface.

10. An electrostatographic printing apparatus, comprising:

a charge receptor in the form of a substrate defining an exposure surface and a development surface opposite the exposure surface;

an exposer, adapted to deliver energy to the exposure surface, creating imagewise charged and discharged areas apparent on the development surface, the exposer including a light source for selectably discharging areas of the charge receptor;

a development unit, operatively disposed adjacent the development surface, for developing the electrostatic latent image by placing toner particles on the development surface; and a shoe, the shoe being transmissive of light emitted by the light source and defining a sliding surface in slidable contact with a portion of the exposure surface and including a gradient index lens array.

11. The apparatus of claim 10, wherein the gradient index lens array focuses light emitted by the light source substantially at the development surface of the charge receptor.

12. An electrostatographic printing apparatus, comprising:

a charge receptor in the form of a substrate defining an exposure surface and a development surface opposite the exposure surface;

an exposer, adapted to deliver energy to the exposure surface, creating imagewise charged and discharged areas apparent on the development surface, the exposer including a light source for selectably discharging areas of the charge receptor;

a development unit, operatively disposed adjacent the development surface, for developing the electrostatic latent image by placing toner particles on the development surface; and a shoe, the shoe being transmissive of light emitted by the light source and defining a sliding surface in slidable contact with a portion of the exposure surface and including a fiber-optic bundle, the fiber-optic bundle defining the sliding surface in slidable contact with a portion of the exposure surface.

13. An electrophotographic printing apparatus, comprising:

a photoreceptor, in the form of a substrate defining a development surface for the retention of an electrostatic latent image thereon; and a shoe, defining a sliding surface in slidable contact with a surface of the photoreceptor, wherein the shoe includes a cylinder lens adapted to focus light from a light source substantially at the development surface of the photoreceptor.

14. The apparatus of claim 13, wherein the shoe focuses light from a light source substantially at the development surface of the photoreceptor, the development surface being opposite the surface of the photoreceptor in contact with the sliding surface of the shoe.

15. The apparatus of claim 13, wherein the sliding surface is convex.

16. An electrophotographic printing apparatus comprising:

a photoreceptor in the form of a substrate defining a development surface for the retention of an electrostatic latent image thereon; and a shoe, defining a sliding surface in slidable contact with a surface of the photoreceptor, wherein the shoe includes a gradient index lens array adapted to focus light from a light source substantially at the development surface of the photoreceptor.

17. The apparatus of claim 16, wherein the gradient index lens array focuses light emitted by the light source substantially at the development surface of the charge receptor, the development surface being opposite the surface of the photoreceptor in contact with the sliding surface of the shoe.

18. An electrophotographic printing apparatus comprising:

a photoreceptor in the form of a substrate defining a development surface for the retention of an electrostatic latent image thereon; and a shoe, defining a sliding surface in slidable contact with a surface of the photoreceptor, the shoe including a fiber-optic bundle, the fiber-optic bundle defining the sliding surface in slidable contact with a portion of the exposure surface, adapted to focus light from a light source substantially at the development surface of the photoreceptor.

19. An electrophotographic printing apparatus, comprising:

a photoreceptor, in the form of a belt encompassing a volume within the apparatus, defining an exposure surface on an inward-facing surface of the belt and a development surface on an outward-facing surface of the belt;

an exposer, including a light source directing a light beam toward the exposure surface of the photoreceptor, creating imagewise charged and discharged areas apparent on the development surface;

a development unit, operatively disposed adjacent the development surface, adapted to develop the electrostatic latent image by applying to the development surface toner particles suspended in a liquid medium;

a shoe, defining a sliding surface in slidable contact with a portion of the exposure surface, the shoe being transmissive of light emitted by the light source, and adapted to focus light from the light source substantially at the development surface of the photoreceptor; and a light-transmissive fluid lubricant disposed between the sliding surface of the shoe and the exposure surface of the photoreceptor, the lubricant being miscible with the liquid medium.

20. An electrophotographic printing apparatus, comprising:

a photoreceptor, in the form of a belt encompassing a volume within the apparatus, defining an exposure surface on an inward-facing surface of the belt and a development surface on an outward-facing surface of the belt, the belt being movable in a process direction;

an exposer, including at least one light source directing a first light beam toward a first exposure location and a second light beam toward a second exposure location of the exposure surface of the photoreceptor along the process direction;

a first development unit and a second development unit, respectively disposed adjacent the development surface at locations along the process direction downstream of the first exposure location and the second exposure location, each development unit adapted to develop an electrostatic latent image by applying to the development surface toner particles suspended in a liquid medium;

a shoe disposed at each exposure location, each shoe defining a sliding surface in slidable contact with a portion of the exposure surface, the shoe being transmissive of light emitted by the light source, and adapted to focus light from the light source substantially at the development surface of the photoreceptor; and a light-transmissive fluid lubricant disposed between the sliding surface of each shoe and the exposure surface of the photoreceptor, the lubricant being miscible with the liquid medium.

* * * * *